US008215925B2

(12) United States Patent
Garland et al.

(10) Patent No.: US 8,215,925 B2
(45) Date of Patent: Jul. 10, 2012

(54) PUMP ASSEMBLY AND TAPPET THEREFOR

(75) Inventors: Paul Francis Garland, Gillingham (GB); Andrew D Brown, Faversham (GB)

(73) Assignee: Delphi Technologies Holding S.arl, Troy, MI (US)

( * ) Notice: Subject to any disclaimer, the term of this patent is extended or adjusted under 35 U.S.C. 154(b) by 399 days.

(21) Appl. No.: 12/283,012

(22) Filed: Sep. 9, 2008

(65) Prior Publication Data

US 2009/0101860 A1 Apr. 23, 2009

(30) Foreign Application Priority Data

Oct. 18, 2007 (EP) ..... 07254144

(51) Int. Cl.
*F04B 1/04* (2006.01)
*F04B 27/04* (2006.01)

(52) U.S. Cl. ..... 417/273

(58) Field of Classification Search ..... 417/269, 417/273, 410.3, 481, 415, 470, 471; 123/193.6, 123/193.4; 92/72, 130 C
See application file for complete search history.

(56) References Cited

U.S. PATENT DOCUMENTS

2004/0091377 A1 5/2004 Uryu et al.

FOREIGN PATENT DOCUMENTS

| | | | |
|---|---|---|---|
| DE | 198 44 326 | | 4/2000 |
| DE | 19844326 | * | 4/2000 |
| DE | 103 13 745 | | 10/2004 |
| EP | 1 557 558 | | 7/2005 |
| JP | 2004-218459 | | 8/2004 |
| WO | 2005/031151 | | 4/2005 |

OTHER PUBLICATIONS

DE19844326, Rainer Haeberer, Radial Piston Pump, Germany Jun. 4, 2000, F04B1/04, English translation.*
European Search Report dated Feb. 28, 2008.
Japan Office Action dated Jul. 4, 2011.

* cited by examiner

*Primary Examiner* — Charles Freay
*Assistant Examiner* — Bryan Lettman
(74) *Attorney, Agent, or Firm* — Thomas N. Twomey

(57) ABSTRACT

A tappet suitable for use with a fluid pump includes a side wall portion and an end face which define an internal chamber of the tappet, the end face having a drive surface for co-operating with a drive arrangement, in use, and a plurality of vents through the end face for allowing fluid flow between the internal chamber and an area outside the tappet. A plurality of longitudinal grooves are formed in an internal surface of the side wall portion, the grooves communicating with respective the vents to form a flow path for fluid into the internal chamber.

12 Claims, 4 Drawing Sheets

PUMP ASSEMBLY AND TAPPET THEREFOR

TECHNICAL FIELD

The present invention relates to a pump assembly and to a tappet for such a pump assembly.

BACKGROUND OF THE INVENTION

In a known pump assembly, an intermediate drive member in the form of a tappet transmits drive from a cam mechanism to a pumping plunger in order to pressurize fluid in a pumping chamber for delivery to, for example, a common rail of a diesel engine fuel injection system. The tappet reduces lateral forces applied to the pumping plunger so that generally the pumping plunger is driven by the tappet along its longitudinal axis. A known tappet is generally cup-shaped and has a cylindrical side wall portion and a base end portion. Vents are provided in the side wall portion to allow a lubricating fluid to flow from a region around the cam mechanism to a region within the tappet so that hydraulic forces do not inhibit free movement of the tappet within a tappet bore.

However, the edges of such vents in the side wall portion can be susceptible to excessive wear because contact between the tappet and tappet bore is intensified at the edges. In order to alleviate such wear, the edges may be chamfered, but such chamfering increases manufacturing costs. Secondly, the tappet tilts, albeit to a relatively small degree, with respect to the axis of the pumping plunger and the edges of the vents, chamfered or otherwise, hinder free rotation of the tappet in the bore when the tappet is tilted. Free rotation is desirable to distribute loading and wear between a lower surface of the tappet and a surface of the cam mechanism. Thirdly, the vents may become partially obscured in use in the bore particularly when the tappet is located towards its maximum range of movement within the bore. If the vents become obscured, fluid flow through the vents is restricted.

SUMMARY OF THE INVENTION

It is against this background that the present invention provides a pump assembly comprising a pump housing having an axially extending opening and at least one bore extending generally radially from said axially extending opening, a tappet received for reciprocating sliding movement in said bore and having an internal chamber for receiving a pumping plunger, a pumping plunger which is received in said internal chamber and driven in use by said tappet to pressurize fluid in a pumping chamber when said tappet reciprocates in said bore, a cam rider received in said axially extending opening and having an inner surface co-operable with a cam drive shaft and an outer surface co-operable with said tappet such that rotation of said drive shaft causes said cam rider to drive reciprocating sliding movement of said tappet in said bore. The tappet, also referred to herein as an intermediate drive member, comprises a side wall portion and an end face which define the internal chamber of the tappet, the end face having a drive surface and a plurality of vents through said end face for allowing fluid flow between the internal chamber and an area outside the tappet and wherein a plurality of longitudinal grooves are formed in an internal surface of said side wall portion, said grooves communicating with respective said vents to form a flow path for fluid into the internal chamber.

The end face may comprise a first end surface spaced from said outer surface of said cam rider and a second end surface forming said drive surface and wherein said vents extend through said first end surface.

A return spring may be located in said internal chamber for biasing said tappet and said plunger in a radially inward direction for performing a return stroke; and a spring seat may be located in said internal chamber at said end face of said tappet for seating said return spring.

The plurality of longitudinal grooves formed in the internal surface of said side wall portion communicate with respective said vents to form a flow path for fluid around said spring seat between said internal chamber and said axially extending opening.

Additionally or alternatively, the spring seat may comprise a plurality of vents in fluid communication with one or more of said vents in said end face to form a path for fluid through said spring seat and between said internal chamber and said axially extending opening.

Further, the tappet may be provided with an annular relief that defines an upstanding projection which, together with the spring seat, defines a further path for fluid to flow between the vents in the first end surface and the vents in the spring seat.

From another aspect, the invention provides a tappet of the pump assembly described above and as defined in the appended claims.

BRIEF DESCRIPTION OF THE DRAWINGS

The present invention will now be described, by way of example only, with reference to the accompanying drawings, in which.

DETAILED DESCRIPTION OF THE EMBODIMENTS

Figure 3:
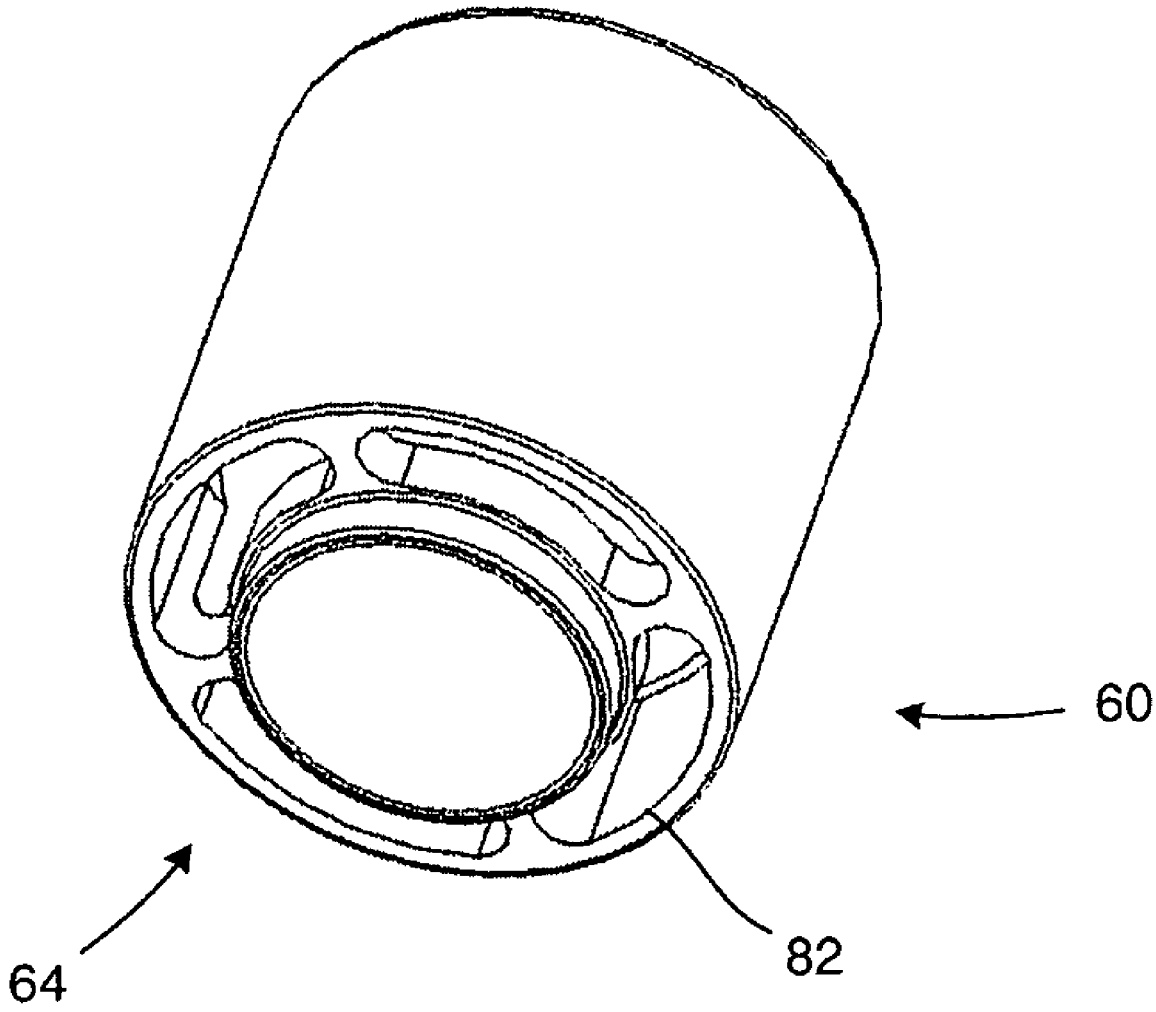
FIG. 3 is a perspective view of a modified intermediate drive member.
Figure 4:
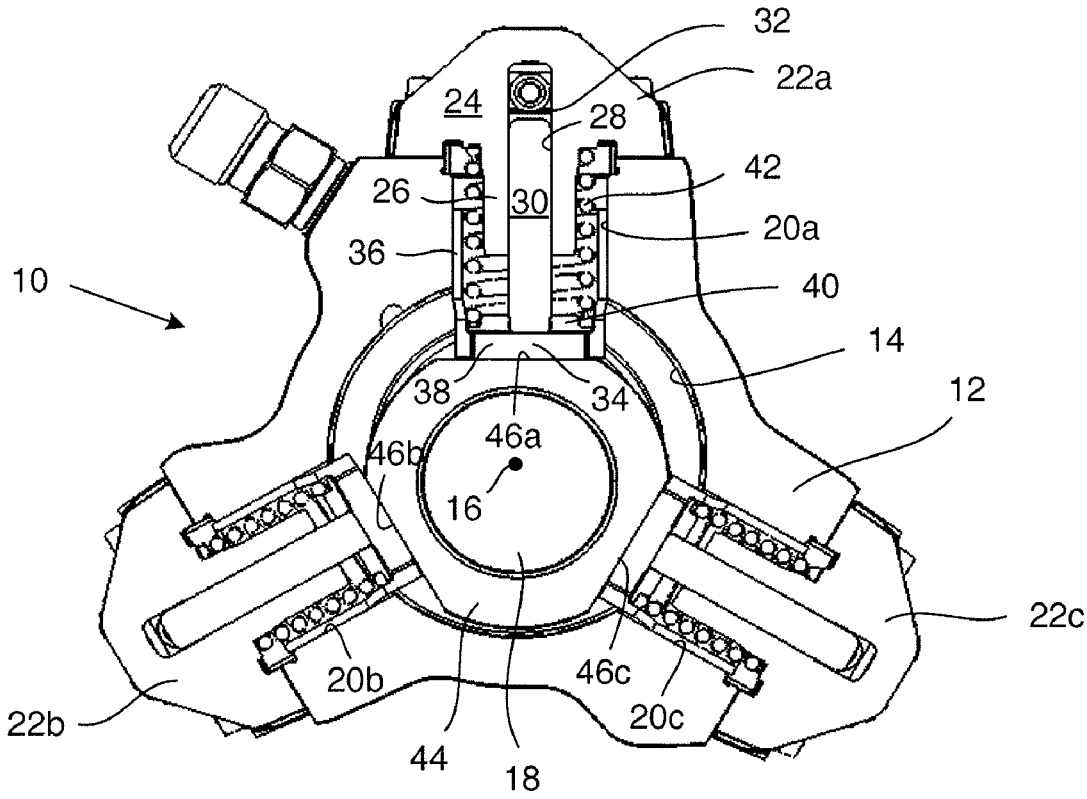
FIG. 4 PRIOR ART
FIG. 4 is a sectional view of a pump assembly.
Figure 5:
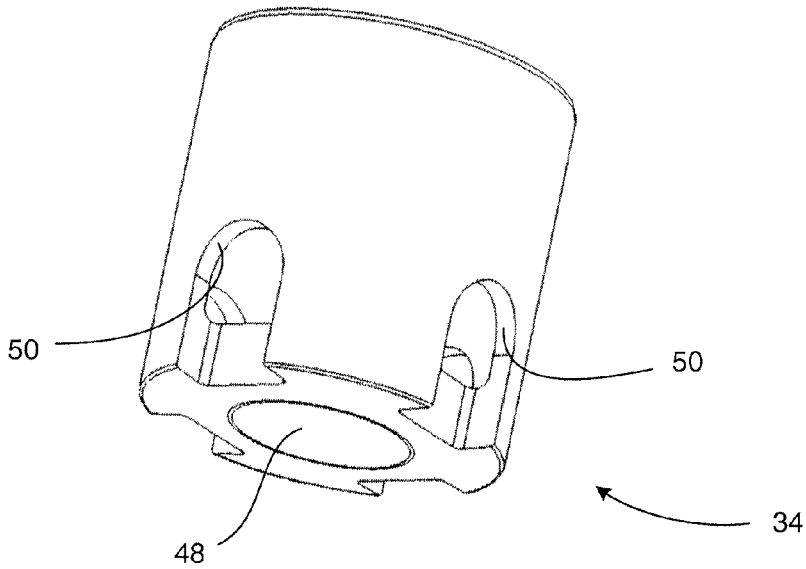
FIG. 5 PRIOR ART
FIG. 5 is a perspective view showing in more detail the intermediate drive member in FIG. 4.

A pump assembly with a known tappet arrangement is described with reference to FIGS. 4 to 6. Referring to FIG. 4, the pump assembly 10 includes a main pump housing 12 provided with an axially extending opening 14. A cam drive shaft (not shown) having an axis of rotation 16 drives an eccentrically mounted cam 18 mounted in opening 14. The main pump housing 12 is provided with first, second and third radially extending openings or through bores 20*a*, 20*b*, 20*c*, each of which communicates, at a radially inner end thereof, with the axially extending opening 14 through the housing 12. A radially outer end of each opening 20*a*, 20*b*, 20*c* receives respective pump heads 22*a*, 22*b* and 22*c*. Each pump head 22*a*, 22*b*, 22*c* is substantially identical and therefore only pump head 20*a* is described in detail below with reference to FIGS. 4 to 6 and also FIGS. 1 to 3.

Pump head 22*a* includes a head portion 24 and a radially inwardly extending extension 26 which projects into a radially outer end of the opening 20*a* in the main pump housing 12. The extension 26 is provided with a plunger bore 28 within which a pumping plunger 30 is received. A blind end of the plunger bore 28 is located within the head portion 24 of the first pump head 22*a*. The blind end of the plunger bore 28 defines, together with a radially outer end face of the plunger 30, a pump chamber 32 to which fuel at relatively low pressure is delivered and within which pressurisation of fuel to a relatively high level suitable for injection takes place as the plunger 30 is driven to perform a pumping stroke upon rotation of the drive shaft. The extension 26 of the pump head 24 provides an increased sealing length for the plunger bore 28, which tends to reduce high pressure fuel leakage from the chamber 32.

A radially inner end of the radially extending opening 20*a* receives an intermediate drive member for the plunger 30 in the form of a tappet 34. The known tappet is shown in more detail in FIGS. 5 and 6. The tappet has a U-shaped or channeled cross section with a generally cylindrical wall portion 36 and a base portion 38. Such a tappet may be referred to as a "bucket tappet". The tappet 34 locates within a radially inner end of the opening 20*a* so that an internal surface of the opening 20*a* is in sliding contact with the cylindrical wall portion 36 and serves to guide longitudinal movement and constrain lateral movement of the tappet 34, in use.

The bucket tappet 34 is coupled to the plunger 28 by suitable means so that relative longitudinal movement between the plunger and tappet is constrained. A spring seat 40 in the form of a plate is received in the internal chamber 52 of the tappet 34 and defines a central aperture for receiving a lower end of the plunger 30 in a press fit. The spring seat 40 locates one end of a plunger return spring 42 and the other end of the plunger return spring 42 abuts the head portion 24 of the first pump head 20*a* so that the spring 42 serves to apply a return biasing force to the plunger 30, and hence to the tappet 34, to drive a plunger return stroke.

Figure 6:
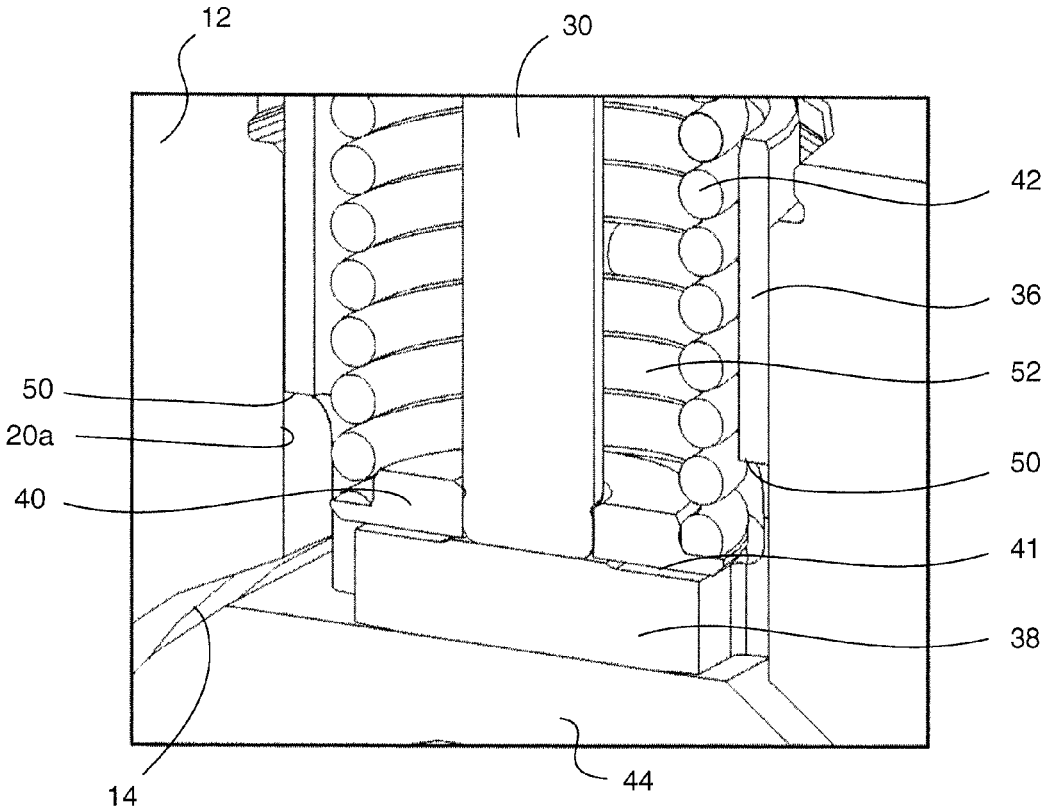
FIG. 6 PRIOR ART
FIG. 6 is a perspective view of the intermediate drive member of FIG. 5 shown in position in the pump assembly in FIG. 4.

As can be seen in FIG. 6, the spring seat 40 is slightly spaced from the base portion 38 so as to define a small gap 41 therebetween, in the region of 1 to 2 mm. Since the spring seat 40 is not in contact with the tappet 34, this ensures that the plunger 30 and the tappet 34 stay together as a pair and that the plunger 30 always follows a full stroke.

The drive shaft co-operates with the cam 18 which, in turn, is co-operable with a generally tubular cam rider member 44 which extends co-axially with the cam 18. On its outer surface the cam rider 44 is provided with first, second and third flattened surfaces 46*a*, 46*b*, 46*c*, referred to as flats. Each one of the flats 46*a*, 46*b*, 46*c* co-operates with the base surface of a tappet 34 for a respective one of the plungers 30. For example, the tappet 34 for the plunger 30 of the first pump head 22*a* co-operates with the first flat 46*a* on the cam rider 44. As the tappet 34 is coupled to the plunger 30, rotation of the shaft causes the cam rider 44 to ride over the surface of the cam 18, thereby imparting drive to both the tappet 34 and the plunger 30. As the tappet 34 is driven, a degree of lateral sliding movement is permitted between the lower surface of the tappet base and the first flat 46*a* of the rider 44. A slipper face 48 (shown in FIG. 5) may be provided for promoting such sliding movement. A lubricating fluid, such as fuel, is provided in opening 14 and bore 20*a* to limit wear due to friction.

As the cam 18 is driven, the tappet 34 is caused to reciprocate within the opening 20*a* and the plunger 30 is caused to reciprocate within the plunger bore 28. The tappet 34 and the pumping plunger 30 are therefore driven together causing the plunger 30 to perform a pumping cycle including a pumping stroke, during which the tappet 34 and the plunger 30 are driven radially outward from the shaft (i.e. for the first pump head 22*a*, vertically upwards in FIG. 4) to reduce the volume of the pump chamber 32. During this pumping stroke the pumping plunger 30 is driven inwardly within its plunger bore 28 and fuel within the pump chamber 32 is pressurised to a relatively high level in a manner which would be familiar to those skilled in this technology field.

During a subsequent plunger return stroke, the tappet 34 and the plunger 30 are urged in a radially inward direction (i.e. for the first pump head 22*a*, vertically downwards in FIG. 4) to increase the volume of the pump chamber 32. During the return stroke of the plunger 30 and its tappet 34, the plunger 30 is urged outwardly from the plunger bore 28 and fuel at relatively low pressure fills the associated pump chamber 32.

The provision of the plunger return spring 42 serves to urge the plunger 30 to perform its return stroke and additionally ensures contact is maintained between the tappet 34 and the flat 46*a* of the rider 44 at all times throughout the pumping cycle. The tappet 34 and the plunger 30 perform cyclical sinusoidal motion and are driven at a maximum frequency of about 120 Hz, although it should be appreciated that this frequency is exemplary only. The tappet 34 typically has a range of travel, between bottom-dead-centre and top-dead-centre, of around 10 millimetres.

Vents or sidewall openings 50 are formed in the cylindrical wall portion 36 of tappet 34 to provide a means for allowing fuel to flow between the chamber 52 within the tappet and the opening 14 in the pump housing 12. Vents 50 reduce the pressure differential between chamber 52 and opening 14 and therefore prevent excessive hydraulic force on the tappet during reciprocating motion. As the tappet 34 and plunger 30 are driven through the pumping stroke, fuel is dispelled from chamber 52 through the vents 50. As the tappet 34 and plunger 30 perform the return stroke, fuel is drawn into chamber 52 through the vents 50.

Vents 50 may be referred to as "church windows" because of their shape. Such vents suffer from the disadvantages discussed above and in order to provide an arrangement which improves or at least mitigates one or all of the disadvantages, a tappet arrangement as described with reference to FIGS. 1 and 2 or FIG. 3 may replace the arrangement shown in FIGS. 4 to 6. Like reference numerals are used in FIGS. 1 to 3 to indicate like components shown in FIG. 4.

Figure 1:
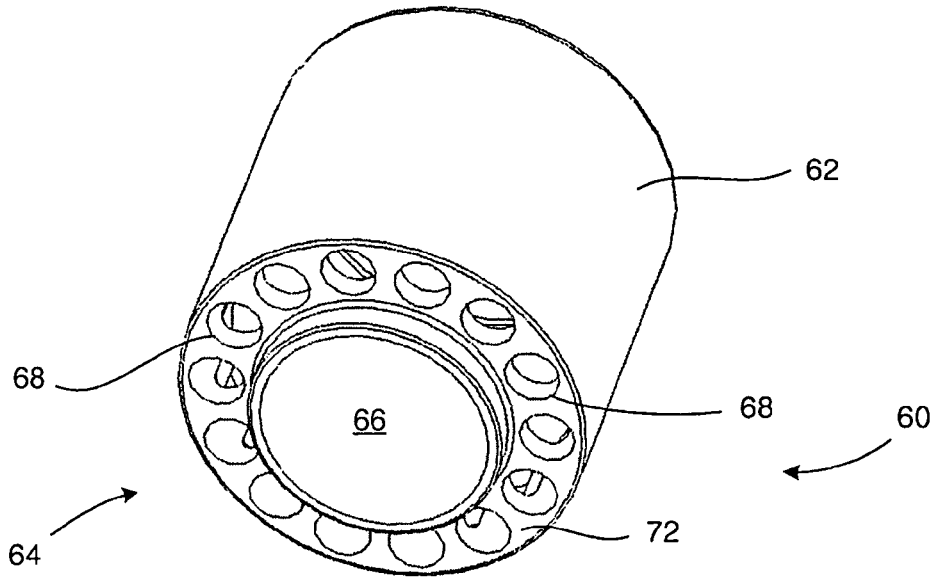
FIG. 1 is a perspective view of an intermediate drive member according to an embodiment of the invention.
Figure 2:
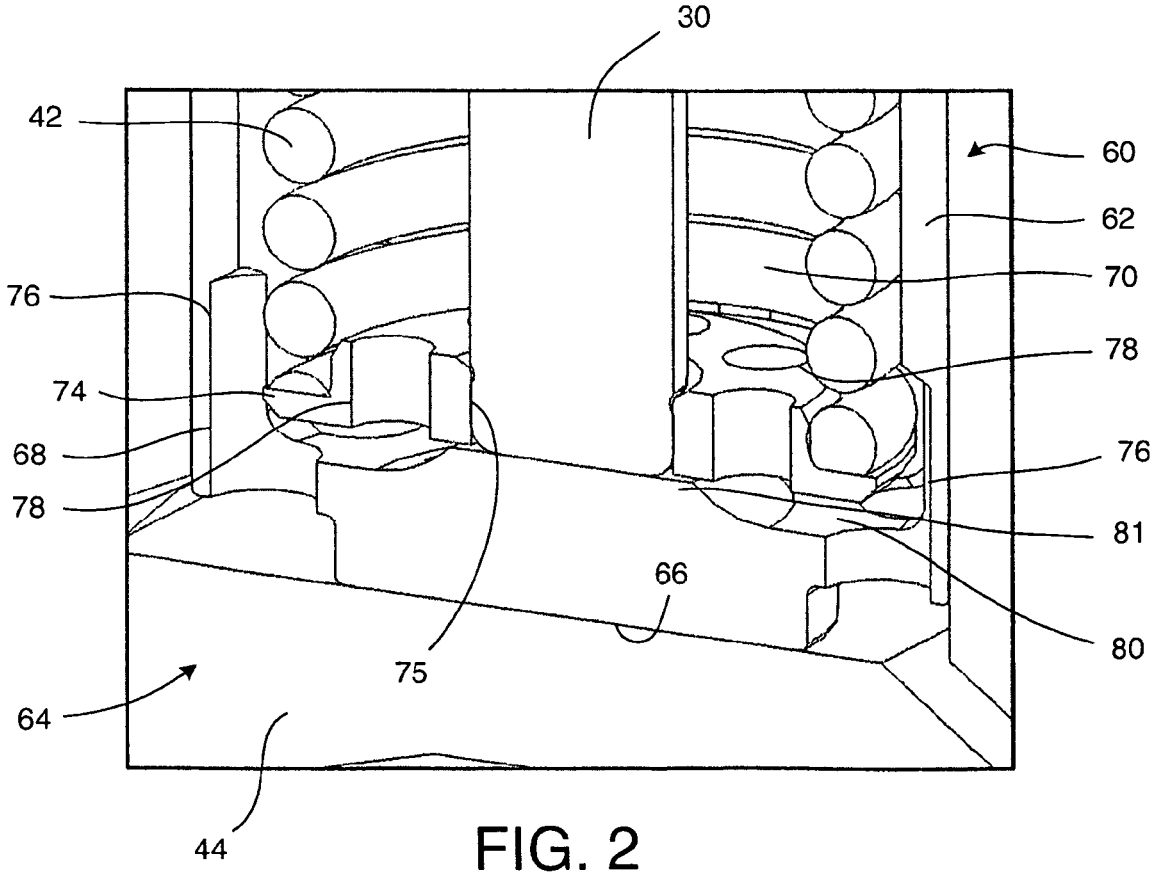
FIG. 2 is a perspective view showing the intermediate drive member in FIG. 2 in position in a pump assembly.

Referring to FIGS. 1 and 2, a tappet 60 comprises a sidewall portion 62 which is generally cylindrical and an end face 64 which extends across an end of the side wall portion 62. The side wall portion 62 is shaped and sized to co-operate with a bore 20*a* of a pump housing 12 to guide reciprocating sliding movement in such a bore. In FIG. 1, the side wall portion 62 is cylindrical which is advantageous as it allows free rotation of tappet 60 in bore 20*a* thus reducing wear on the tappet face and of the tappet side wall in the bore 20*a*.

End face 64 has a drive surface 66 for co-operating with a flat 46*a* such that rotation of the drive shaft causes the cam rider 44 to drive reciprocating sliding movement of tappet 60 in bore 20*a*.

A plurality of vents 68 are provided through end face 64 for allowing fluid flow between opening 14 of the pump housing 12 and an internal chamber 70 of the tappet 60. The end face 64 comprises a first end surface 72 which is spaced from the outer surface, or flat 46*a*, of the cam rider 44 and a second end surface which forms the drive surface 66.

The vents 68 extend through the first end surface 72 so that a space is provided between flat 46*a* of the cam rider 44 and the end face 64 to allow fluid to flow between the end face and the flat prior to or after passage through the vents 68. The drive surface 66 is formed as shown in FIG. 1 by a central stepped portion which extends radially inwardly from the first surface 72 by a distance sufficient to achieve adequate fluid flow between the end face 64 and the flat 46*a*. Preferably the depth of the step is sized such that the flow area approximates the flow area provided by the vents 68 although in the embodiment shown a suitable distance is in the region of between approximately 1 to 5 mm.

The return spring 42 is located in internal chamber 70 for biasing the tappet 60 and plunger 30 in a radially inward direction for performing a return stroke. A spring seat 74 is located in internal chamber 70 adjacent to but slightly spaced from the end face 64 for seating the return spring 42. The spring seat 74 defines a central aperture 75 in which the lower end of the plunger 30 is received in a press fit, thus coupling the plunger 30 and the spring seat 74, such that the spring 42 biases the plunger 30 via the spring seat 74. The spring seat 74 extends across a lateral extent internally of tappet 60 and in order to allow fluid flow between vents 68 and internal chamber 70 a plurality of longitudinal grooves 76 are formed in an internal surface of side wall portion 62 in order to bypass the spring seat 74. The grooves 76 communicate with respective vents 68 to form a flow path for fluid around the spring seat 74 between internal chamber 70 and opening 14 in the pump housing. As shown in FIGS. 1 and 2, the vents 68 may be formed such that they partially intersect the side wall portion 62 in order to form such grooves 76.

The spring seat 74 comprises a plurality of vents 78 in fluid communication with one or more of the vents 68 to form a path for fluid through the spring seat and between the internal chamber 70 and opening 14. In the embodiment of FIGS. 1 and 2, the vents 78 are in the form of circular apertures. The tappet 60 is provided with an annular relief 80, thus defining a central upstanding projection 81, which together with the spring seat 74 defines a fluid flow path of a depth of between 1 and 3 mm, preferably 2 mm, to guide fluid flow between vents 68 and vents 78.

The number, size and pitch circle of the vents 68 are selected to achieve a desired fluid flow between the internal chamber 70 of tappet 60 and opening 14 in the pump housing. As shown in FIGS. 1 and 2, vents 68 constitute generally cylindrical bores through the end face of the tappet 60. However, such vents may be of any suitable shape and size. FIG. 3 shows a modified tappet 60 in which vents 82 through the end face 64 are annular, arcuate slots.

In the axially vented tappet 60, side wall portion 62 provides a smooth and uninterrupted guide surface for guiding movement of the tappet in the tappet bore 20*a*. Accordingly, wear of the tappet during use is distributed generally evenly over the surface of the side wall portion 62. Further, when the tappet tilts to a relatively small degree in the bore, rotation of the tappet is not restricted by any formations, such as vents, in the side wall portion 62. Still further, the vents 68, 82 are formed in the end face 64 of the tappet 60 so that they do not become occluded by bore 20*a* over the tappet's full range of movement.

It will be appreciated that various modifications may be made to the embodiment described above without departing from the inventive concept as defined by the appended claims. For example, although the invention has been described with reference to a pump 10 having three pumping chambers 20*a*, 20*b*, 20*c*, it should be appreciated that this need not be the case and the invention is applicable to pumps having one, or more than one, pumping chamber with an associated pumping plunger.

The invention claimed is:

1. A tappet suitable for use with a fluid pump, the tappet comprising:

a side wall portion and an end face that, together, define an internal chamber of the tappet, the end face having a drive surface for co-operating with a drive arrangement, in use; and a plurality of vents through said end face for allowing fluid flow between the internal chamber and an area outside the tappet;

wherein a plurality of longitudinal grooves are formed only in an internal surface of said side wall portion, said grooves communicating with respective ones of said vents to form a flow path for fluid into the internal chamber.

2. The tappet as claimed in claim 1:

wherein said end face comprises a first end surface that is spaced from a second end surface, and forming the drive surface, for co-operating with the drive arrangement, in use; and wherein said vents extend through said first end surface.

3. The tappet as claimed in claim 1:

wherein the tappet includes a spring seat located in said internal chamber adjacent said end face, wherein said spring seat comprises a plurality of vents in fluid communication with one or more of said vents in said end face to form a path for fluid through said spring seat, and wherein the grooves form a flow path around said spring seat.

4. The tappet as claimed in claim 2:

wherein the tappet includes a spring seat located in said internal chamber adjacent said end face, wherein said spring seat comprises a plurality of vents in fluid communication with one or more of said vents in said end face to form a path for fluid through said spring seat, and wherein the grooves form a flow path around said spring seat.

5. The tappet as claimed in claim 3, wherein the tappet is provided with an annular relief defining an upstanding projection that, together with the spring seat, defines a fluid flow path to guide flow between the vents in the end face and the vents in the spring seat.

6. The tappet as claimed in claim 4, wherein the tappet is provided with an annular relief defining an upstanding projection that, together with the spring seat, defines a fluid flow path to guide flow between the vents in the first end surface and the vents in the spring seat.

7. The tappet as claimed in claim 2, wherein the vents in the first end surface are arcuate slots.

8. A pump assembly comprising:

a pump housing having an axially extending opening and at least one bore extending generally radially from said axially extending opening;

at least one tappet as claimed in claim 1 received for reciprocating sliding movement in said at least one bore;

at least one pumping plunger which is received in the internal chamber of the at least one tappet and driven, in use, by said at least one tappet to pressurize fluid in a pumping chamber when said at least one tappet reciprocates in said at least one bore;

a cam rider received in said axially extending opening and having:

an inner surface co-operable with a cam drive shaft; and an outer surface co-operable with said at least on tappet such that rotation of said cam drive shaft causes said cam rider to drive reciprocating sliding movement of said at least on tappet in said at least one bore;

wherein the side wall portion of the at least one tappet cooperates with the at least one bore to guide said reciprocating sliding movement, and wherein the vents and the longitudinal grooves, together, define a fluid flow path from the axial opening to the internal chamber of the tappet.

9. The pump assembly as claimed in claim 8, comprising:

a return spring located in said internal chamber for biasing said at least on tappet and said at least one plunger in a radially inward direction for performing a return stroke; and a spring seat located in said internal chamber adjacent said end face of said at last on tappet for seating said return spring.

10. The pump assembly as claimed in claim 8, wherein a portion of the end face of the tappet is spaced from the drive surface and the outer surface of the cam rider.

11. The pump assembly as claimed in claim 9, wherein the spring seat comprises a plurality of vents through said spring seat in fluid communication with one or more vents in said end face to form a path for fluid through said spring seat and between said internal chamber and said axially extending opening.

12. A pump assembly comprising:

a pump housing having an axially extending opening and at least one bore extending generally radially from said axially extending opening;

an intermediate drive member received for reciprocating sliding movement in said at least one bore, the intermediate drive member comprising a side wall portion and an end face that, together, define an internal chamber of the intermediate drive member, the end face having a drive surface and a plurality of vents through said end face for allowing fluid flow between the internal chamber and an area outside the intermediate drive member;

a pumping plunger which is received in the internal chamber of the intermediate drive member and driven in use by said intermediate drive member to pressurize fluid in a pumping chamber when said intermediate drive member reciprocates in said bore;

a cam rider received in said axially extending opening and having an inner surface co-operable with a cam drive shaft and an outer surface co-operable with said intermediate drive member such that rotation of said drive shaft causes said cam rider to drive reciprocating sliding movement of said intermediate drive member in said bore;

wherein a plurality of longitudinal grooves are formed only in an internal surface of said side wall portion, said grooves communicating with respective ones of said vents to form a flow path for fluid into the internal chamber;

wherein a spring seat is located in said internal chamber adjacent said end face, the spring seat having a plurality of vents in fluid communication with one or more of said vents in said end face to form a path for fluid through said spring seat and between said internal chamber and said axially extending opening; and wherein the side wall portion of the intermediate drive member cooperates with the bore to guide said reciprocating sliding movement and wherein the vents and the longitudinal grooves, together, define a fluid flow path from the axial bore to the internal chamber of the intermediate drive member.

* * * * *